US008882373B2

(12) United States Patent
Inoue

(10) Patent No.: US 8,882,373 B2
(45) Date of Patent: Nov. 11, 2014

(54) IMAGE PROCESSING DEVICE AND SHEET FEEDING MECHANISM

(75) Inventor: Nobuhiro Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 107 days.

(21) Appl. No.: 13/444,995

(22) Filed: Apr. 12, 2012

(65) Prior Publication Data

US 2012/0269566 A1 Oct. 25, 2012

(30) Foreign Application Priority Data

Apr. 20, 2011 (JP) ..... 2011-093720
Oct. 14, 2011 (JP) ..... 2011-226860

(51) Int. Cl.
*B41J 11/00* (2006.01)
*B65H 7/12* (2006.01)

(52) U.S. Cl.
CPC ..... *B65H 7/125* (2013.01); *B65H 2301/3122* (2013.01); *B65H 2553/30* (2013.01); *B65H 2701/1912* (2013.01); *B65H 2301/321* (2013.01)
USPC ..... 400/582

(58) Field of Classification Search
USPC ..... 400/582
See application file for complete search history.

(56) References Cited

U.S. PATENT DOCUMENTS 6,290,129 B2 * 9/2001 Momose ..... 235/449
6,473,519 B1 * 10/2002 Pidhirny et al. ..... 382/140
7,090,131 B2 * 8/2006 Natsuno ..... 235/449
7,404,559 B2 * 7/2008 Yoshimura et al. ..... 271/263
7,654,522 B2 * 2/2010 Tonami ..... 271/262
7,819,400 B2 * 10/2010 Miyoshii et al. ..... 271/265.04
7,976,016 B2 * 7/2011 Kinoshita ..... 271/149
8,246,262 B2 * 8/2012 Kinoshita et al. ..... 400/582
2001/0042956 A1 * 11/2001 Minoru et al. ..... 271/265.04
2005/0275159 A1 12/2005 Yoshimura et al.
2006/0145412 A1 7/2006 Tagawa et al.
2008/0203654 A1 8/2008 Chujo et al.

FOREIGN PATENT DOCUMENTS

JP 2004269241 A 9/2004
JP 2005082350 A 3/2005
JP 2007276965 A 10/2007
JP 2008207885 A 9/2008
JP 2010173742 A 8/2010

* cited by examiner

*Primary Examiner* — Anthony Nguyen

(74) *Attorney, Agent, or Firm* — Lowe Hauptman & Ham, LLP

(57) ABSTRACT

Factory adjustment and repairs are simplified while assuring the accuracy of a multifeed prevention function. A main unit has a conveyance path that conveys sheets, and a processing unit that applies a specific process to the sheets conveyed through the conveyance path, and a multifeed detection unit is removably disposed to the main unit. The multifeed detection unit has a sheet-passing unit disposed contiguously to the conveyance path, an ultrasonic transmitter disposed facing the sheet-passing unit, and an ultrasonic receiver disposed opposite the ultrasonic transmitter with the sheet-passing unit therebetween.

20 Claims, 9 Drawing Sheets

IMAGE PROCESSING DEVICE AND SHEET FEEDING MECHANISM

RELATED APPLICATIONS

The present application is based on, and claims priority from, Japanese Application Number 2011-093720, filed Apr. 20, 2011 and Japanese Application Number 2011-226860, filed Oct. 14, 2011, the disclosure of which is hereby incorporated by reference herein in its entirety.

BACKGROUND

1. Technical Field

The present invention relates to an image processing device that applies an image process such as printing or scanning to checks or other sheet media, and relates more particularly to a sheet feeding mechanism that is used in such an image processing device.

2. Related Art

A means of preventing feeding plural sheets together (known as multifeeding) is commonly incorporated in sheet feeding mechanisms known from the related art. Japanese Unexamined Patent Appl. Pub. JP-A-2004-269241 teaches a means of preventing such multifeeding. The sheet feeding mechanism described in JP-A-2004-269241 has a transmitting ultrasonic sensor and a receiving ultrasonic sensor disposed on opposite sides of the conveyance path on the upstream and downstream sides of the feed rollers disposed to the conveyance path. To detect sheet multifeeding, output from the receiving ultrasonic sensor is measured when output from the transmitting ultrasonic sensor is stopped, and the sum of this output plus a specific compensation value is set as the threshold value for multifeed detection. Whether multifeeding occurs during sheet conveyance is determined by comparing this threshold value with the output from the receiving ultrasonic sensor.

However, the detection level of the receiving sensor in this configuration for detecting multifeeding depends greatly upon variations in the performance of the receiving sensor and transmitting sensor and installation. A control process for adjusting the sensors and adjusting the threshold value is therefore required for each device in order to accurately set the threshold value for multifeed detection, thus complicating factory adjustment. In addition, if a sensor fails, the failed sensor must be replaced and the sensor adjustment process repeated, and repair therefore becomes a time-consuming process.

More specifically, because the receiving sensor must detect ultrasonic waves at a precise level when an ultrasonic sensor is used for the sensor as described in JP-A-2004-269241, the complexity of the adjustment process increases accordingly.

SUMMARY

An image processing device and a sheet feeding mechanism according to the present invention enable easier adjustment at the factory and during repair than the related art while also assuring the accuracy of the multifeed prevention function.

To solve at least part of the foregoing problem, the invention can be achieved by embodiments such as described below.

One aspect of the invention is an image processing device including: a main unit having a conveyance path for conveying a sheet, and a processing unit that applies a specific process to the sheet conveyed through the conveyance path;

and a multifeed detection unit that is removably installed to the main unit, and has a sheet-passing unit disposed contiguously to the conveyance path, an ultrasonic transmitter disposed facing the sheet-passing unit, and an ultrasonic receiver disposed opposite the ultrasonic transmitter with the sheet-passing unit therebetween.

This configuration enables assembling the multifeed detection unit, configuring the installation of the ultrasonic transmitter and receiver, and performing circuit adjustment tasks separately from the main unit.

In another aspect of the invention, the multifeed detection unit also has a paper feed mechanism that supplies the sheet through the sheet-passing unit to the conveyance path.

This aspect of the invention enables adjusting for manufacturing variations in paper feed mechanism performance at the multifeed detection unit level.

In another aspect of the invention, the ultrasonic transmitter and ultrasonic receiver are on the downstream side of the paper feed mechanism and the upstream side of the processing unit on the conveyance path.

This aspect of the invention enables detecting multifeeding immediately after multifeeding occurs, and stopping sheet conveyance before processing by the processing unit when multifeeding occurs.

In another aspect of the invention, the ultrasonic transmitter and ultrasonic receiver are closer to the paper feed mechanism than the processing unit.

This aspect of the invention assures sufficient time to stop the processing unit after multifeeding is detected, and can reliably stop sheet conveyance before processing by the processing unit when multifeeding occurs even if the sheet is conveyed at a high paper feed rate.

In another aspect of the invention, at least one paper feed roller is located on the downstream side of the ultrasonic transmitter and ultrasonic receiver and the upstream side of the processing unit.

This aspect of the invention enables stopping the sheet before the sheet is fed by the paper feed roller into the processing unit when multifeeding occurs.

In another aspect of the invention, the processing unit includes a print unit that prints on the sheet, and a reading unit that reads information on the sheet; and the reading unit is on the upstream side of the print unit and the downstream side of the ultrasonic transmitter and ultrasonic receiver on the conveyance path.

This aspect of the invention assures sufficient time to stop the sheets before printing on the sheets when multifeeding occurs, and can prevent printing on the sheets.

In another aspect of the invention, the multifeed detection unit also has a drive unit that drives the paper feed mechanism.

When sound and vibration from the drive unit become noise during multifeed detection, this aspect of the invention enables adjusting the output level of the ultrasonic receiver according to the noise characteristics at the multifeed detection unit.

In another aspect of the invention, the multifeed detection unit also has a hopper that holds the sheets; and the paper feed mechanism feeds the sheets held in the hopper to the conveyance path.

This aspect of the invention enables adjusting the output level of the ultrasonic receiver according to the noise characteristics of the hopper, such as sheets sliding against each other, on the multifeed detection unit level.

In another aspect of the invention, the multifeed detection unit has a receiver-side circuit unit that applies a specific process to an output signal from the ultrasonic receiver.

This aspect of the invention enables adjusting the receiver-related circuit at the multifeed detection unit level.

In another aspect of the invention, the receiver-side circuit unit is disposed to the multifeed detection unit at a position facing the outside.

This aspect of the invention enables easily adjusting the receiver-side circuit unit at the multifeed detection unit level.

In another aspect of the invention, the receiver-side circuit has an amplifier circuit that amplifies the output signal of the ultrasonic receiver and outputs the amplified signal, and a comparator that compares at least a part of the output value of the amplified signal with a specific threshold value.

This aspect of the invention enables adjusting the gain of and comparing the ultrasonic receiver output signal with a threshold value at the multifeed detection unit level.

In another aspect of the invention, the multifeed detection unit also has a transmitter-side circuit unit that outputs a drive signal to the ultrasonic transmitter.

This aspect of the invention also enables circuit adjustment of the ultrasonic transmitter at the multifeed detection unit level.

In another aspect of the invention, the main unit also has a control unit that controls the receiver-side circuit unit and the transmitter-side circuit unit; and connectors that respectively connect the control unit to the receiver-side circuit unit and the transmitter-side circuit unit are disposed between the main unit and the multifeed detection unit.

This aspect of the invention enables electrically connecting the multifeed detection unit to the main unit by simply connecting the connectors.

Another aspect of the invention is a sheet feeding mechanism that is installed to a device having a main unit that applies a specific process to a sheet conveyed through a conveyance path, and supplies the sheet to the conveyance path, the sheet feeding mechanism including: an installation base that is removably installable to the main unit; a sheet feeding unit that is disposed to the installation base and supplies the sheet to the conveyance path; and a multifeed detection unit that detects multifeeding of the sheets to the conveyance path and is disposed to the installation base, and has a sensor unit that detects sheet multifeeding.

This aspect of the invention renders the installation base, the sheet feeding unit, and the sensor unit that detects multifeeding as a unit that can be installed to the main unit of the device.

In another aspect of the invention, the sensor unit includes an ultrasonic transmitter, an ultrasonic receiver disposed opposite the ultrasonic transmitter, and a circuit unit that processes at least the output signal of the ultrasonic receiver.

This aspect of the invention enables circuit adjustment of the ultrasonic receiver at the sheet feeding mechanism level.

In another aspect of the invention, the circuit unit is installed to the sheet feeding mechanism so that the circuit unit is exposed to the outside.

This configuration enables circuit adjustment to be performed easily from the outside.

In another aspect of the invention, the sheet feeding unit includes a sheet holding unit that holds the sheets in a stack, and a paper feed roller that supplies the sheets in the sheet holding unit to the conveyance path.

This configuration enables adjusting the sensor unit to accommodate noise and vibrations produced from sheet feeding, and sheet feeding characteristics.

In another aspect of the invention, the sheet feeding mechanism also has a drive unit that drives the paper feed roller.

This configuration enables adjusting the sensor unit to accommodate the noise and vibrations produced by the drive unit during sheet feeding.

In another aspect of the invention, the sheets are supplied standing on edge from the sheet feeding unit to the conveyance path.

This configuration enables disposing the sensors of the sensor unit horizontally opposite each other.

In another aspect of the invention, the sheets are checks.

This aspect of the invention enables rendering the sheet feeding mechanism with a size suited to small forms.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Figure 1:
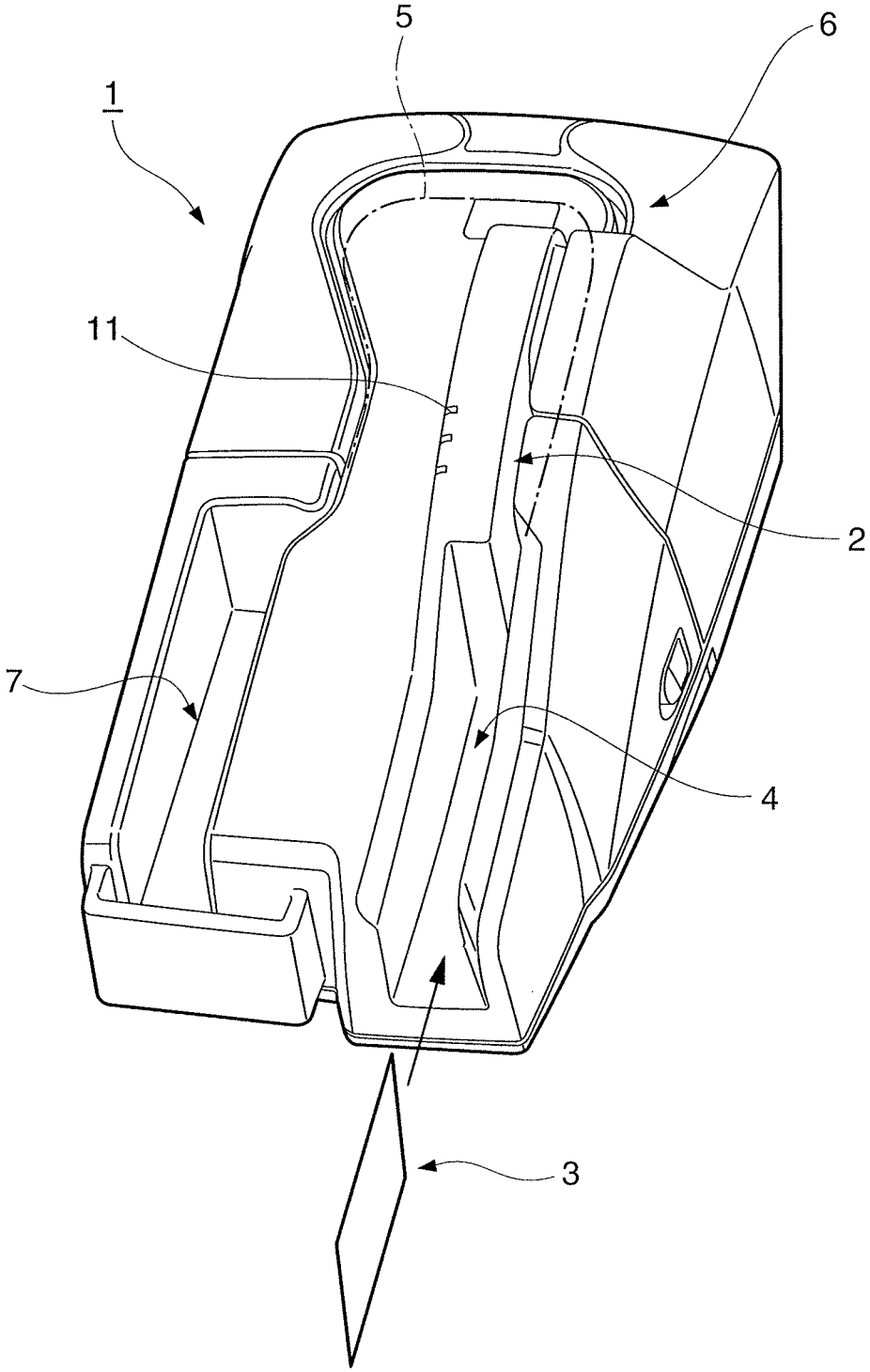
FIG. 1 is an external oblique view of a check processing device according to a preferred embodiment of the invention.

FIG. 1 is an oblique view of a check processing device (image processing device) 1 according to a preferred embodiment of the invention. The check processing device 1 has a hopper (sheet storage unit) 4 that stores checks and other sheets 3 stacked on edge is disposed to the main unit 2. The check processing device 1 also has a conveyance path 5 for conveying the sheets 3 fed from the hopper 4, a processing unit 6 that prints on, reads magnetic data from, or scans the sheets 3 conveyed through the conveyance path 5, and a discharge unit 7 that receives from the conveyance path 5 the sheets 3 passed through the conveyance path 5 after processing by the processing unit 6 ends.

Figure 2:
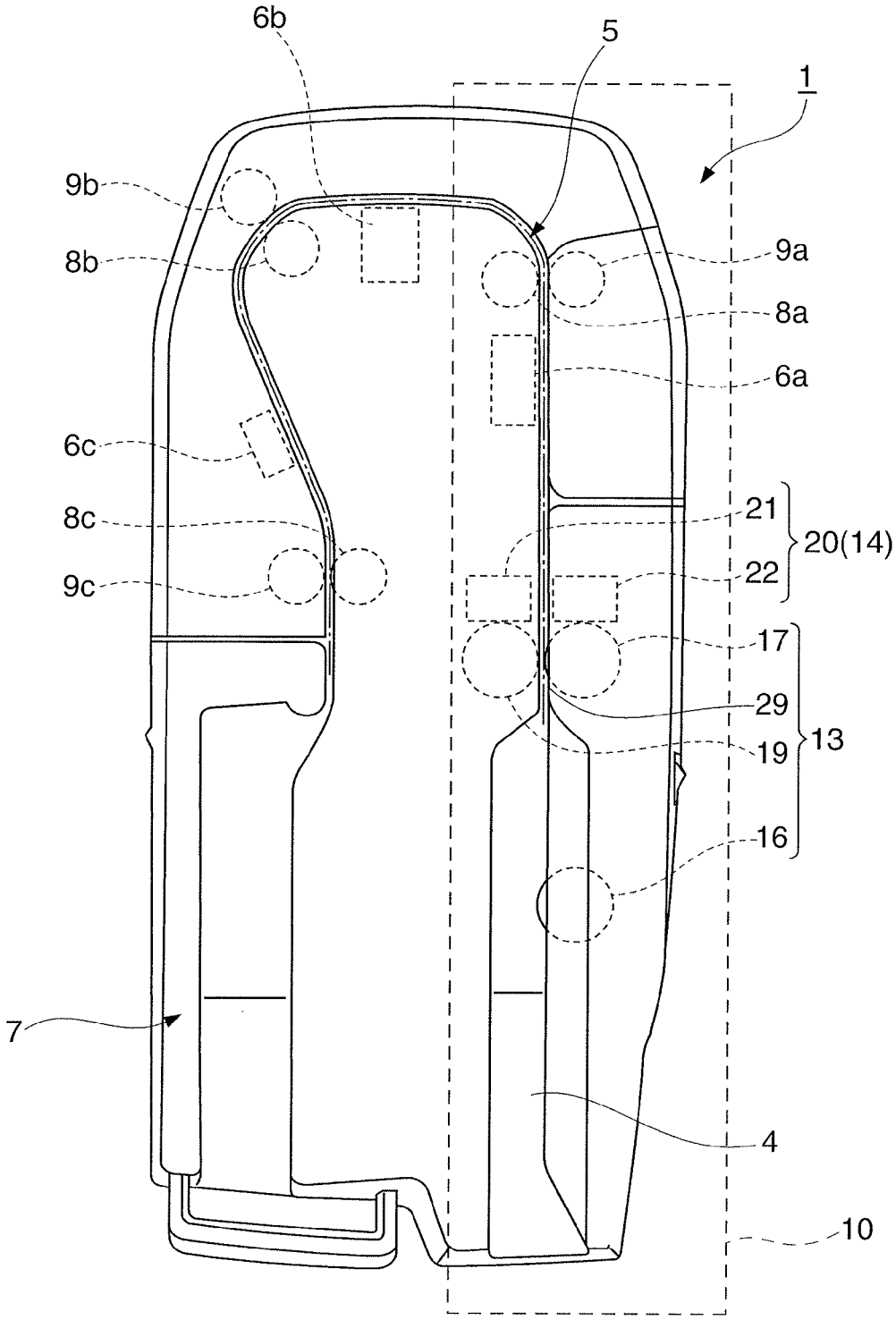
FIG. 2 is a top view of the check processing device shown in FIG. 1.

FIG. 2 is a top view of the check processing device 1. As shown in FIG. 2, the check processing device 1 has the hopper 4 at the upstream end of the conveyance path 5, and a magnetic scanner 6*a*, print unit 6*b*, and optical scanner 6*c* disposed in order from the upstream end of the conveyance path 5 as processing units 6. The discharge unit 7 is disposed to the downstream end of the conveyance path 5.

First to third paper feed rollers 8*a* to 8*c* that are driven by a motor 18 described below (see FIG. 5), and first to third follower rollers 9*a* to 9*c*, are disposed to the conveyance path 5 sequentially from the upstream end. The sheets 3 are conveyed through the conveyance path 5 guided by the first to third paper feed rollers 8*a* to 8*c* and first to third follower rollers 9*a* to 9*c*.

Figure 3:
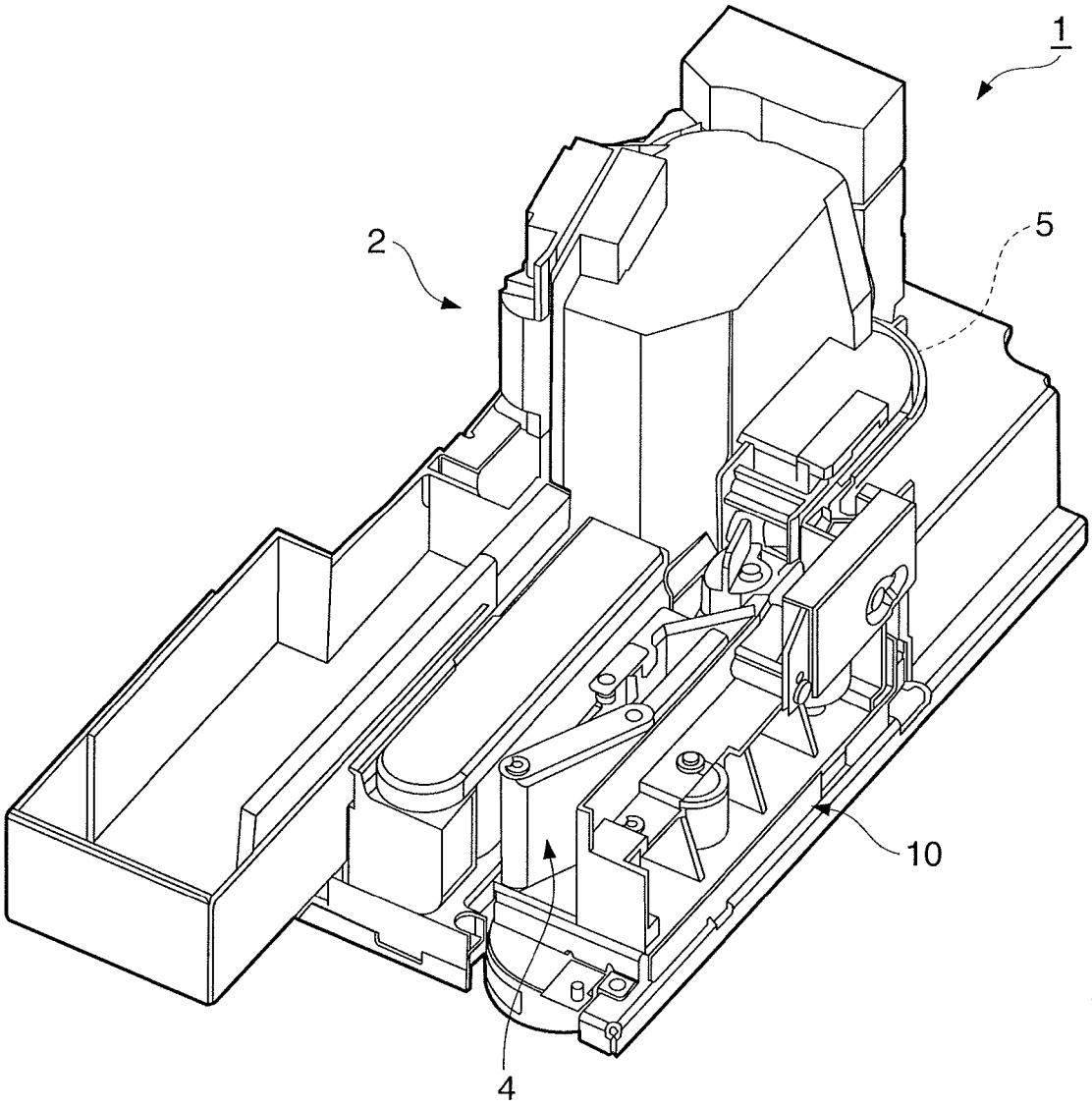
FIG. 3 is an oblique view of the inside of the check processing device shown in FIG. 1.
Figure 4:
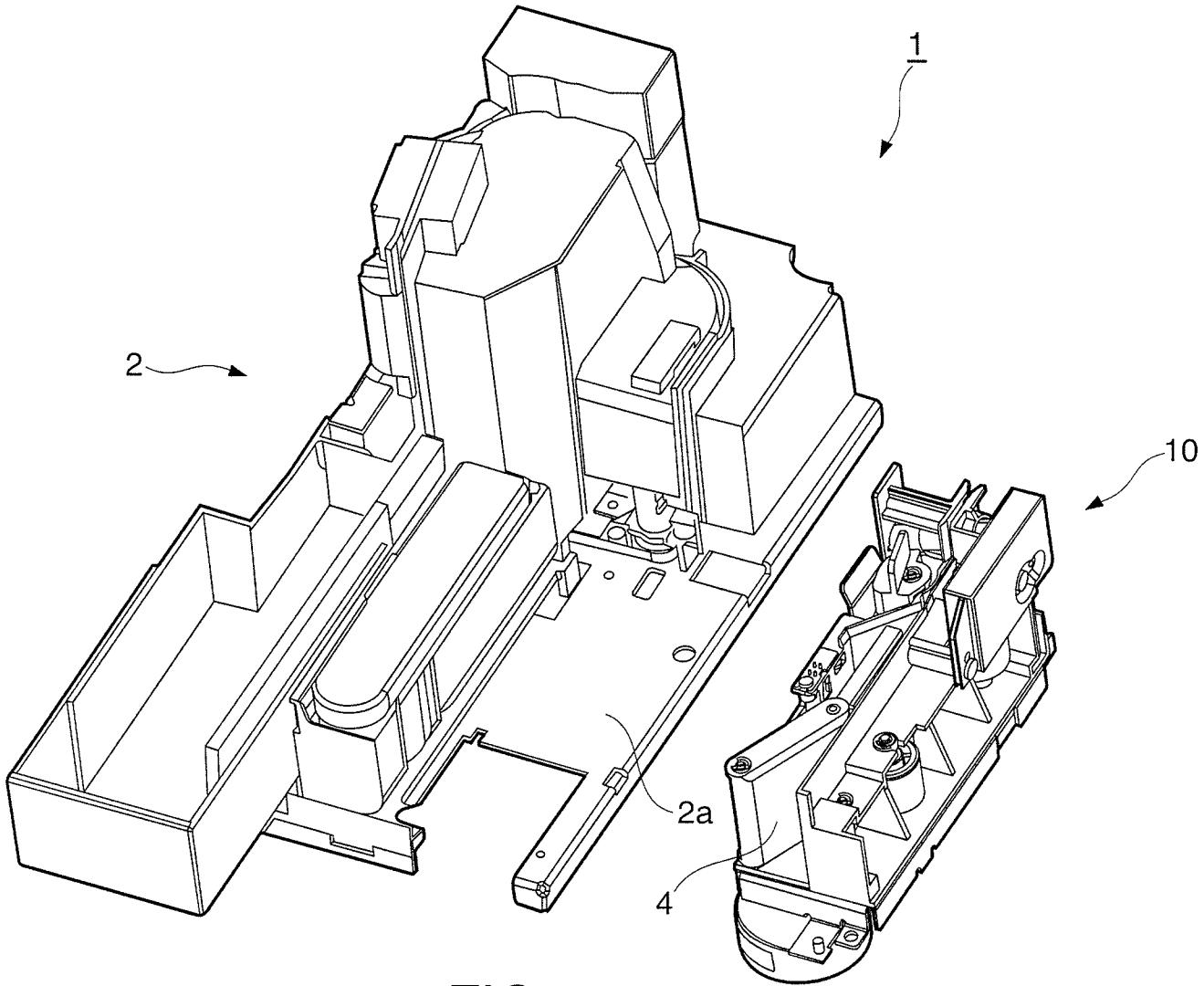
FIG. 4 is an exploded oblique view of the inside of the check processing device shown in FIG. 1.

FIG. 3 is an oblique view showing the internal configuration of the check processing device 1. As shown in FIG. 3, the area around the hopper 4 is constructed as a sheet feeding mechanism (multifeed detection unit) 10 for feeding sheets 3 into the conveyance path 5. As shown in FIG. 4, the sheet feeding mechanism 10 can be detached from the main unit 2.

Figure 5:
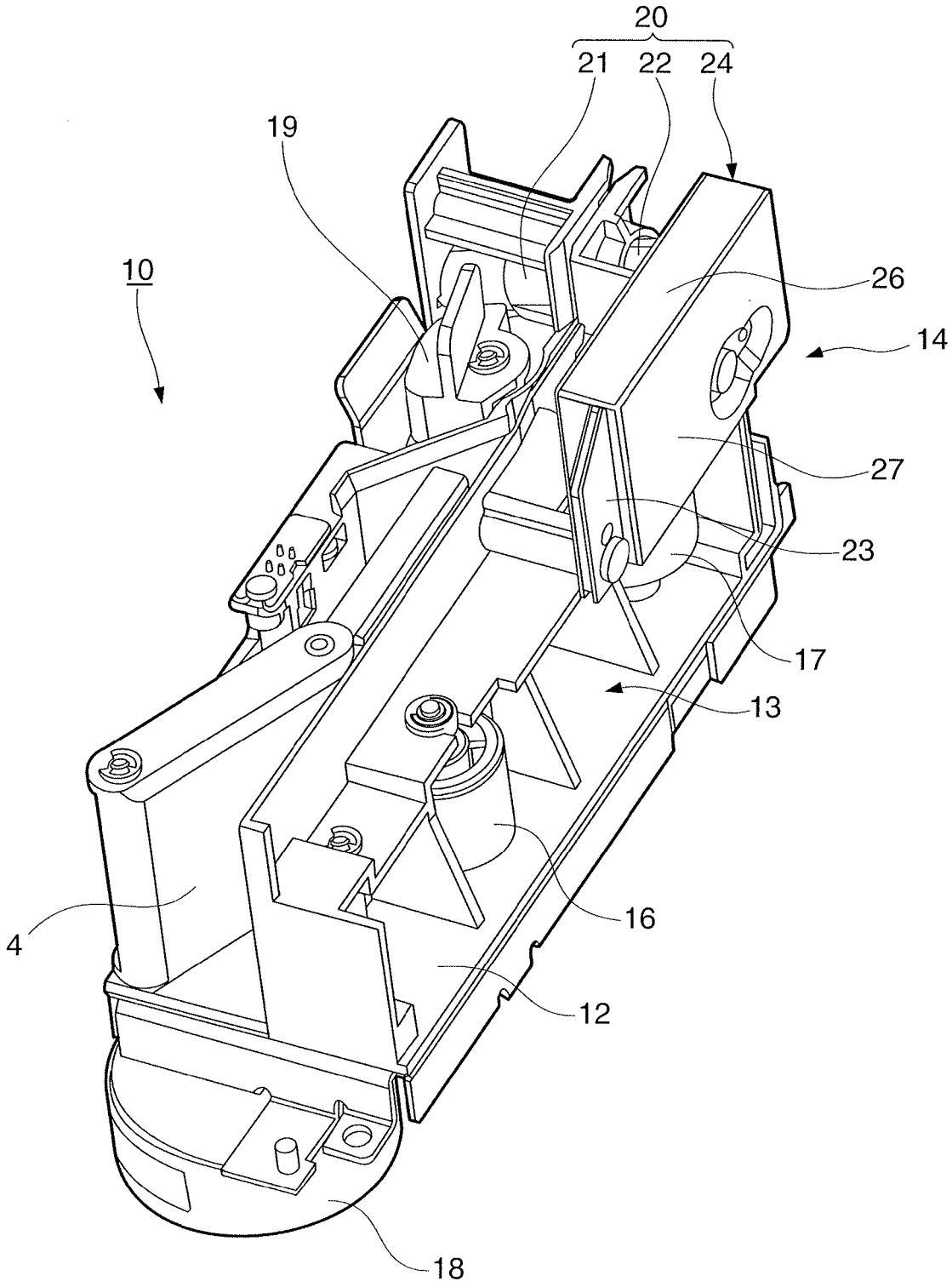
FIG. 5 is an oblique view of the sheet feeding mechanism shown in FIG. 4.

FIG. 5 is a detailed oblique view of the sheet feeding mechanism 10. As shown in the figure, the sheet feeding mechanism 10 includes an installation base 12, a sheet feeding unit 13 that supplies the sheets 3 to the conveyance path 5 and is mounted on the installation base 12, and a multifeed detection unit 14 that is disposed to the installation base 12 and detects multifeeding of the sheets 3. The installation base 12 is a plate that is removably fastened with screws, for example, to the base 2*a* of the main unit 2 (see FIG. 4).

The sheet feeding unit 13 includes the hopper 4, a pickup roller 16, a feed roller 17 for conveying sheets 3 into the conveyance path 5, and a retard roller 19 disposed to the installation base 12.

The pickup roller 16 is disposed so that it can move in and out of the hopper 4 by a retraction mechanism not shown. Rotationally driving the pickup roller 16 feeds the sheets 3 stored on edge in the hopper 4 to the sheet-passing unit 29 (see FIG. 2).

The feed roller 17 is located on the downstream side of the pickup roller 16. Part of the feed roller 17 is exposed in the sheet-passing unit 29. A sheet 3 passing the sheet-passing unit 29 is fed into the conveyance path 5 by rotationally driving the feed roller 17.

The retard roller 19 is disposed opposite the feed roller 17 in the sheet-passing unit 29. The retard roller 19 is configured to rotate only when torque applied thereto exceeds a specific threshold. As a result, when multifeed sheets 3 attempt to pass the sheet-passing unit 29, friction between the sheet 3 on the feed roller 17 side and the feed roller 17 is sufficient for the sheet 3 to be held by the feed roller 17 and fed into the conveyance path 5. However, because sufficient friction is not produced between the sheet 3 touching the retard roller 19 and the sheet 3 touching the feed roller 17, sufficient torque is not transmitted from this sheet 3 to the retard roller 19. As a result, when sheets 3 are multifed, the retard roller 19 does not turn because torque exceeding the threshold is not applied, and only the sheet 3 touching the feed roller 17 is conveyed to the conveyance path 5. Multifeeding sheets 3 can therefore be prevented.

The motor (drive unit) 18 is disposed below the installation base 12. The motor 18 is connected to the foregoing pickup roller 16, feed roller 17, and first to third paper feed rollers 8*a* to 8*c* through gears and an endless belt, and is the drive source for rotationally driving these other parts.

The multifeed detection unit 14 located shortly downstream from the sheet-passing unit 29 has a sensor unit 20 for detecting multifeeding of sheets 3 into the conveyance path 5. The sensor unit 20 includes an ultrasonic transmitter 21, ultrasonic receiver 22, and a circuit unit 24 with a receiver-side circuit board (receiver-side circuit unit) 23 for processing output signals from the ultrasonic receiver 22. The ultrasonic transmitter 21 is disposed facing the sheet-passing unit 29, and the ultrasonic receiver 22 is disposed opposite the ultrasonic transmitter 21 with the sheet-passing unit 29 therebetween. The circuit unit 24 is exposed outside the sheet feeding mechanism 10. In this embodiment of the invention the ultrasonic transmitter 21 and ultrasonic receiver 22 are disposed adjacent to the feed roller 17 and retard roller 19 on the downstream side.

Figure 6:
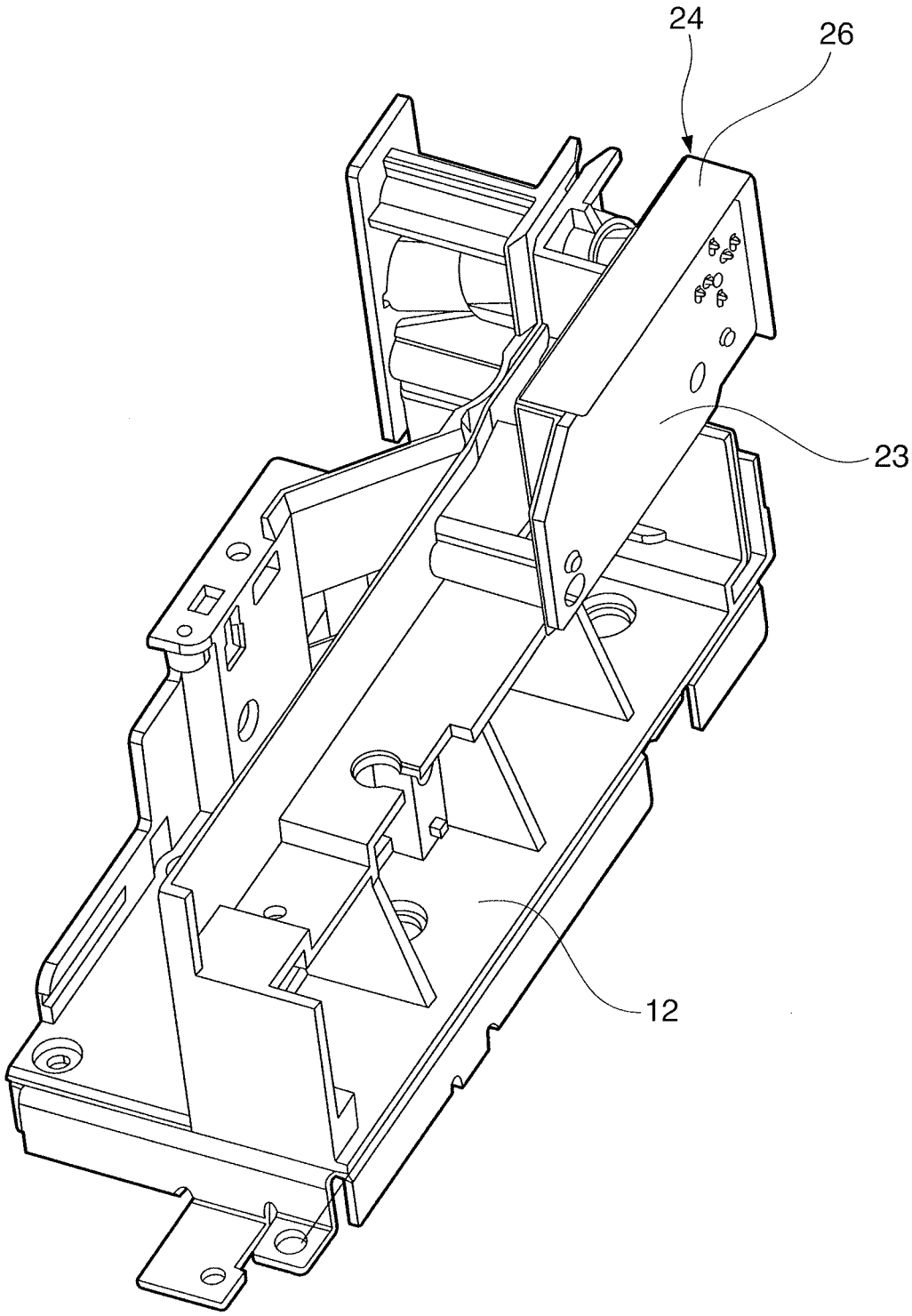
FIG. 6 is an oblique view showing the internal structure of the circuit part of the sheet feeding mechanism shown in FIG. 5.

FIG. 6 shows the structure of the installation base 12 and circuit unit 24 in detail. As shown in the figure, the circuit unit 24 is disposed to a circuit board mounting unit 26, which is disposed to the installation base 12. The receiver-side circuit board 23 is attached to the circuit board mounting unit 26 so that the side on which devices are mounted is exposed on the outside of the multifeed detection unit 14. A protective cover 27 (see FIG. 5) that protects the top of the receiver-side circuit board 23 is attached to the circuit board mounting unit 26 with a screw, for example.

The operation of the check processing device 1 configured as described above is described next.

The sheets 3 stored in a stack in the hopper 4 are fed by the pickup roller 16 to the sheet-passing unit 29. The sheets 3 delivered to the sheet-passing unit 29 are separated by the retard roller 19 and fed one at a time by the feed roller 17 to the conveyance path 5.

Next, the sheet 3 that passed the sheet-passing unit 29 passes between the ultrasonic transmitter 21 and ultrasonic receiver 22 disposed just downstream from the feed roller 17 and retard roller 19, and is conveyed to the magnetic scanner 6*a*. The operation of the sensor unit 20 including the ultrasonic transmitter 21 and ultrasonic receiver 22 is described in detail below.

As the sheet 3 passes the magnetic scanner 6*a*, the magnetic scanner 6*a* reads magnetic information written on the sheet 3, and the captured magnetic information is sent to the CPU 34 of the check processing device 1 (FIG. 7) or other external terminal not shown.

The sheet 3 that passed the magnetic scanner 6*a* is then guided by the first paper feed roller 8*a* and first follower roller 9*a* and conveyed to the print unit 6*b*. Based on commands from the CPU 34, the print unit 6*b* records the required information on the sheet 3.

After the printing process of the print unit 6*b* is completed, the sheet 3 is further guided by the second paper feed roller 8*b* and second follower roller 9*b* and conveyed to the optical scanner 6*c*. While the sheet 3 passes the magnetic scanner 6*a*, the optical scanner 6*c* optically scans the sheet 3, and sends the captured optical information to the CPU 34 of the check processing device 1 or other external terminal not shown.

The sheet 3 that passed the optical scanner 6*c* is then guided by the third paper feed roller 8*c* and third follower roller 9*c* and discharged into the discharge unit 7. The sequence of processes performed on the sheet 3 by the check processing device 1 thus ends.

Problems such as described below can occur if sheets 3 are multifed through the conveyance path 5 in a check processing device 1 that operates as described above. For example, when multifed sheets 3 pass the magnetic scanner 6*a* and optical scanner 6*c*, the magnetic information and optical information cannot be accurately read. The print unit 6*b* also cannot print on the sheet 3 that should be printed, and the printing process is applied to the wrong sheet 3. More specifically, if the sheet 3 is a check, the mistakenly printed check must be disposed of reliably so that the check cannot be reused, and the recovery process becomes complicated.

Multifeeding of sheets 3 is prevented by the retard roller 19 described above, but unintended multifeeding of sheets 3 can still occur. The sensor unit 20 that detects sheet 3 multifeeding is therefore disposed to the check processing device 1 according to this embodiment of the invention to reliably prevent the above processing sequence from being performed when sheets 3 are multifed.

When the sensor unit 20 disposed downstream adjacent to the sheet feeding unit 13 detects sheet 3 multifeeding, the sensor unit 20 reports that multifeeding was detected to the CPU 34 (FIG. 7) of the check processing device 1. When this multifeeding detection report is received, the CPU 34 stops driving the motor 18 and stops driving the feed roller 17 and first paper feed roller 8*a*, and stops processing by the magnetic scanner 6*a*, print unit 6*b*, and optical scanner 6*c*. As a result, the multifed sheets 3 are not conveyed through the conveyance path 5, the operating sequence described above is stopped, and the sheets 3 are not mistakenly processed.

More particularly, the first paper feed roller 8*a* is located between the print unit 6*b* and the ultrasonic transmitter 21 and ultrasonic receiver 22 in this embodiment of the invention. When the sensor unit 20 detects sheet 3 multifeeding, the CPU 34 stops driving or reverses the motor 18 to stop or reverse the first paper feed roller 8*a*, and thereby prevents the sheets 3 from entering the processing unit 6. Because the sheets 3 therefore do not enter the processing unit 6 when sheets 3 are multifed, printing on the sheets 3 by the print unit 6*b* can be prevented.

In addition, when the multifeed detection report is received, the CPU 34 informs the user that multifeeding was detected by sounding an alarm or causing a display indicator 11 (see FIG. 1) to blink. The user than then remove the multifed sheets 3 and take necessary corrective action. Because nothing is printed on the sheets 3 at this time, the sheets 3 can be returned to the hopper 4 so that the sheets 3 can be reprocessed correctly. The user's job is also easier because a complicated recovery operation is not required.

Figure 7:
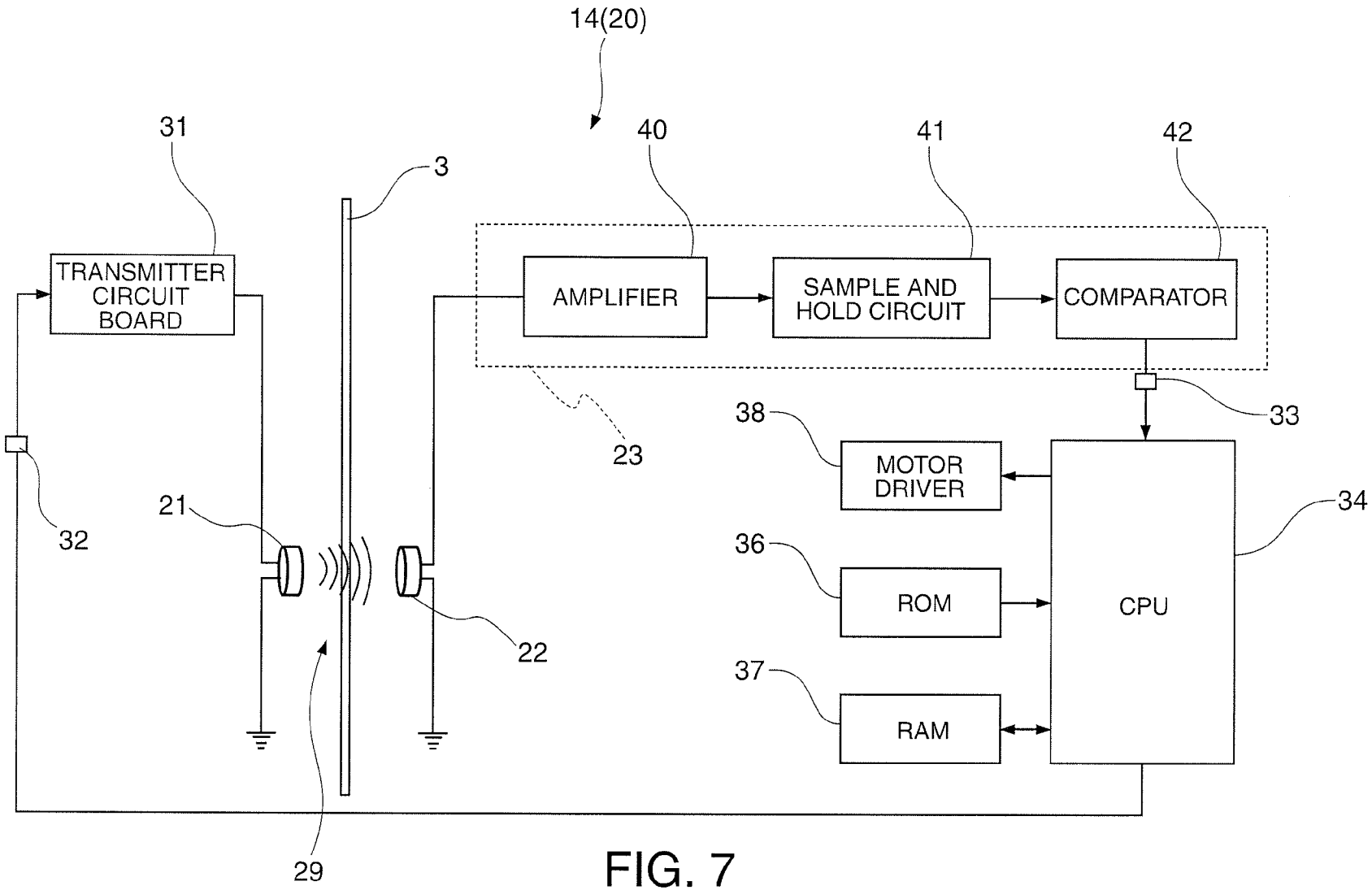
FIG. 7 is a block diagram showing the circuit design of the check processing device shown in FIG. 1.

FIG. 7 is a block diagram showing the circuit configuration of the multifeed detection unit 14. As shown in the figure, the ultrasonic transmitter 21 and ultrasonic receiver 22 are disposed in mutual opposition with the sheet-passing unit 29 disposed contiguously to the conveyance path 5 therebetween. A transmitter circuit board 31 (transmission circuit unit) for supplying drive signals to the ultrasonic transmitter 21 is connected to the ultrasonic transmitter 21, and a receiver-side circuit board 23 for processing the output signals output from the ultrasonic receiver 22 is connected to the ultrasonic receiver 22. The transmitter circuit board 31 and receiver-side circuit board 23 are connected to the CPU 34 (control unit) disposed to the main unit 2 through connectors 32 and 33.

ROM 36 and RAM 37, and the motor driver 38 for driving the motor 18, are connected to the CPU 34. An amplifier 40 for amplifying signals output from the ultrasonic receiver 22, a sample and hold circuit 41 for sampling and holding the peak values of the output signals amplified by the amplifier 40, and a comparator 42 that compares the output value of the output signal held by the sample and hold circuit 41 with a specific voltage and outputs the result as a binary high/low signal, are disposed to the receiver-side circuit board 23.

Factory adjustment of the check processing device 1 is described next. The multifeed detection unit 14 of the check processing device 1 uses a ultrasonic transmitter 21 and ultrasonic receiver 22 in the sensor unit 20, and the performance of an ultrasonic sensor depends greatly upon the installation of the transmitter and receiver. Therefore, in order to appropriately detect sheet 3 multifeeding using the sensor unit 20, circuit adjustment based on the installation of the particular sensor unit 20, and more particularly appropriately adjusting the settings of the receiver-side circuit board 23 that processes the output signals of the ultrasonic receiver 22, is required.

Figure 8:
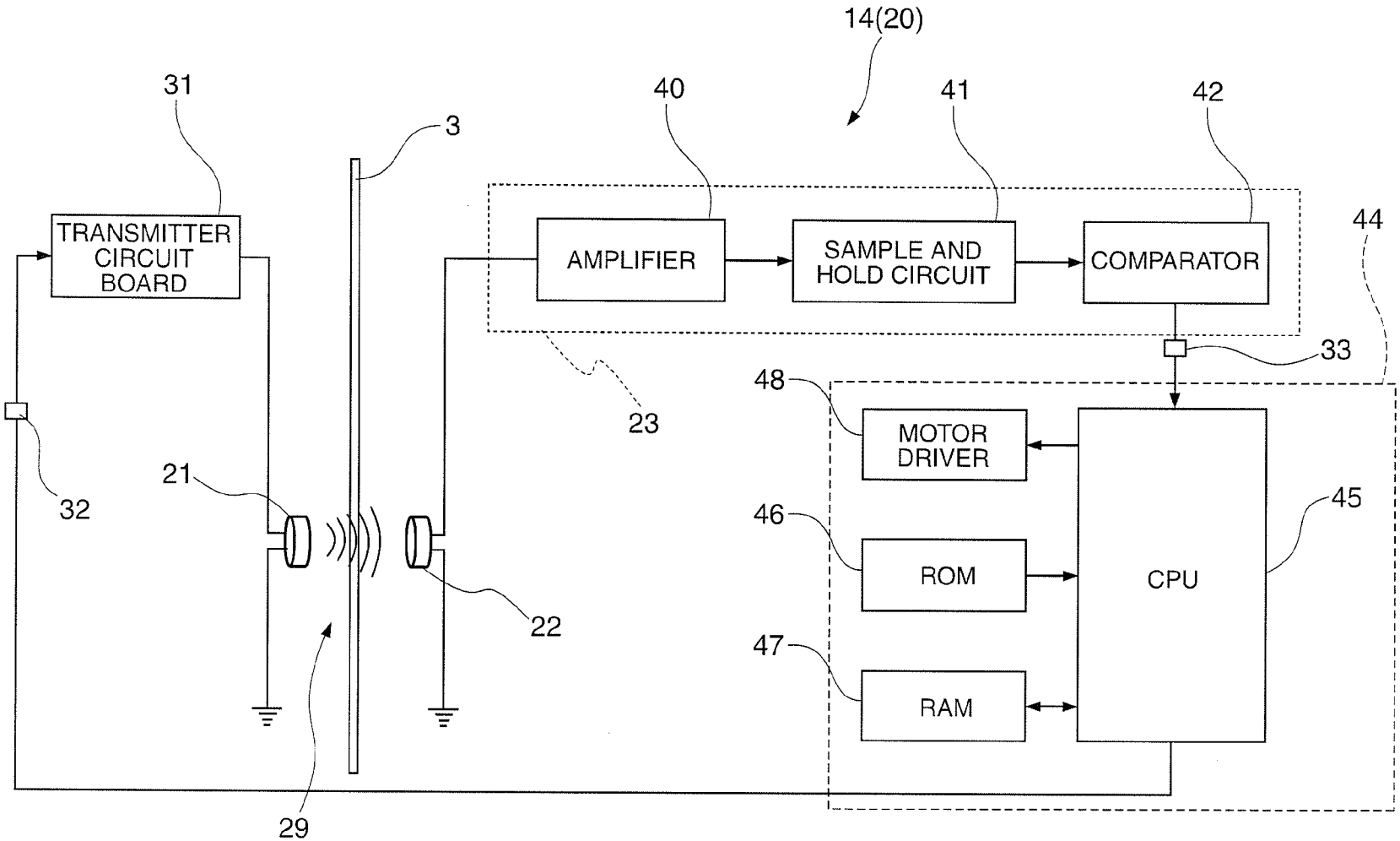
FIG. 8 is a block diagram showing the circuit design of the adjustment device for adjusting the sheet feeding mechanism circuit.

Receiver-side circuit board 23 settings are adjusted as described below before installing the sheet feeding mechanism 10 in the check processing device 1. First, as shown in FIG. 8, the sensor unit 20 of the sheet feeding mechanism 10, which is removed from the main unit 2, is connected to an adjustment device 44 through connectors 32, 33. The adjustment device 44 is configured identically to the CPU 34, ROM 36, RAM 37, and motor driver 38 shown in FIG. 7, and has a CPU 45, ROM 46, RAM 47, and motor driver 48.

The circuit is first adjusted based on the detected ultrasonic signal level during normal sheet conveyance. This is done by the CPU 45 of the adjustment device 44 driving the motor 18 of the sheet feeding mechanism 10 through the motor driver 48, and feeding a single sheet 3 to the sheet-passing unit 29. At the same time, the CPU 45 of the adjustment device 44 sends a control signal to the transmitter circuit board 31. Based on this control signal, the transmitter circuit board 31 drives the ultrasonic transmitter 21, and causes the ultrasonic transmitter 21 to emit an ultrasonic signal.

The emitted ultrasonic waves pass through the sheet 3 and are received by the ultrasonic receiver 22. The output signal from the ultrasonic receiver 22 is amplified by the amplifier 40 and input to the sample and hold circuit 41. The sample and hold circuit 41 samples and holds the peak output value from the amplifier 40.

A specific voltage that is obtained from prior tests is input as a reference voltage to the comparator 42, and the comparator 42 compares this specific voltage with the value held by the sample and hold circuit 41. Note that a value used as the threshold value for detecting sheet multifeeding in comparable products can be used as the specific voltage.

If the value held by the sample and hold circuit 41 is greater than this specific voltage, the comparator 42 outputs a specific first output value (such as a HIGH signal). Based on this output value, the CPU 45 determines that normal conveyance of the sheet 3 is appropriately detected.

However, if the value held by the sample and hold circuit 41 is less than the specific voltage, the comparator 42 outputs a specific second output value (such as a LOW signal). In this case, the CPU 45 determines that normal conveyance of the sheet 3 is not appropriately detected. In this case, the gain of the amplifier 40 is adjusted and the test repeated until the specific first output value is output from the comparator 42, that is, until the CPU 45 determines that normal conveyance of the sheet 3 is appropriately detected.

The circuit is then adjusted based on the ultrasonic signal detection level when sheets are multifed. This operation starts by recreating a situation in which two sheets 3 are in the sheet-passing unit 29. The CPU 45 of the adjustment device 44 then sends a control signal to the transmitter circuit board 31, and based thereon the transmitter circuit board 31 outputs an ultrasonic signal from the ultrasonic transmitter 21. The ultrasonic signals output from the ultrasonic transmitter 21 pass through the two sheets 3 and are received by the ultrasonic receiver 22. The output signal from the ultrasonic receiver 22 is amplified by the amplifier 40 and input to the sample and hold circuit 41. The sample and hold circuit 41 samples and holds the peak output value of the amplifier 40.

Because the ultrasonic waves are input to the ultrasonic receiver 22 after passing through two sheets 3, the value held by the sample and hold circuit 41 should be less than when a single sheet 3 is fed normally. Whether the value held by the sample and hold circuit 41 is less than a specific voltage is therefore determined.

More specifically, when the value held by the sample and hold circuit 41 is less than the specific voltage input as a reference voltage to the comparator 42, a specific second output value (such as a LOW signal) is output from the comparator 42. As a result, the CPU 45 determines that sheet 3 multifeeding is appropriately detected, and circuit adjustment of the sensor unit 20 ends.

However, if the value held by the sample and hold circuit 41 is greater than the specific voltage, a specific first output value (such as a HIGH signal) is output from the comparator 42. As a result, the CPU 45 determines that sheet 3 multifeeding is not appropriately detected. In this case, the gain of the amplifier 40 is adjusted and the gain of the amplifier 40 is reduced until the specific second output value is output from the comparator 42. When the gain of the amplifier 40 is reduced, a normal sheet 3 feeding state is recreated again in the sheet-passing unit 29 to check if normal sheet 3 conveyance is appropriately detected at this setting.

By repeating this process, the sheet feeding mechanism 10 can be configured so that multifeeding is appropriately detected by the multifeed detection unit 14. When this adjustment is completed, the motor 18 of the sheet feeding mechanism 10 is driven by the motor driver 48, the pickup roller 16 and feed roller 17 are driven, normal sheet 3 conveyance and multifeeding are both recreated, and whether the CPU 45 accurately detects multifeeding in both situations is tested. In this case, the sensor unit 20 installation may be adjusted, the output level of the ultrasonic transmitter 21 may be adjusted, or the specific voltage (threshold) input as the reference value to the comparator 42 may be adjusted as required.

After adjustment of the multifeed detection unit 14 is completed as described above, the sheet feeding mechanism 10 is installed to the main unit 2 and connected to the main unit 2 through connectors 32, 33. Factory adjustment of the check processing device 1 is thus completed.

Because the sheet feeding mechanism 10 (multifeed detection unit) is removably installed to the main unit 2 in the check processing device 1 described above, the sheet feeding mechanism 10 can be manufactured and assembled, and the sensor unit 20 can be installed and adjusted, separately from the main unit 2 assembly process. As a result, adjustment of the multifeed detection unit can be simplified and standardized prior to shipping. In addition, so that the performance of the sheet feeding mechanism 10 as a multifeed detection unit can be assured, the sheet feeding mechanism 10 can be replaced when a multifeed detection function failure occurs, and repair work can be simplified.

In addition, the sheet feeding mechanism 10 has a sheet feeding unit 13 for supplying sheets 3 through the sheet-passing unit 29 to the conveyance path 5. As a result, the sensor unit 20 can be adjusted to accommodate manufacturing variations in the sheet feeding performance of the paper feed mechanism, and the multifeed detection performance of each sheet feeding mechanism 10 can be easily assured.

A motor 18 for driving the feed roller 17 and pickup roller 16 of the sheet feeding unit 13 is also disposed to the sheet feeding mechanism 10. As a result, when sound and vibrations produced by the motor 18 become noise during multifeed detection, the output level from the ultrasonic receiver 22 can be adjusted on the sheet feeding mechanism 10 according to the noise characteristics of the motor 18. This enables improving the accuracy of multifeed detection by the ultrasonic receiver 22.

The sheet feeding mechanism 10 also has a hopper 4 for storing sheets 3, and the sheet feeding unit 13 feeds sheets 3 from the hopper 4 into the conveyance path 5. As a result, the output level from the ultrasonic receiver 22 can be adjusted on the sheet feeding mechanism 10 to accommodate hopper 4 characteristics such as the sound of sheets 3 rubbing against each other, and the accuracy of multifeed detection by the ultrasonic receiver 22 can be further improved.

A receiver-side circuit board 23 for applying a specific process to the output signals of the ultrasonic receiver 22 is also disposed to the sheet feeding mechanism 10. As a result, circuit adjustments can be made on the sheet feeding mechanism 10, making factory shipping adjustment and repair even easier.

The receiver-side circuit board 23 is disposed to the sheet feeding mechanism 10 so that the receiver-side circuit board 23 faces the outside. As a result, circuit adjustment is simple, and factory adjustment is simplified.

More particularly, the receiver-side circuit board 23 has an amplifier 40 and a comparator 42 that compares at least part of the output value with a specific voltage (threshold value) set as a reference value. As a result, the gain of the output signal can be adjusted and the output signal of the ultrasonic receiver 22 compared with the threshold value as a stand-alone unit. Adjustment according to the characteristics of the individual unit can therefore be done easily.

A transmitter circuit board 31 that outputs a drive signal to the ultrasonic transmitter 21 is also disposed to the sheet feeding mechanism 10. As a result, the output level of the ultrasonic transmitter 21 can be adjusted on the unit level, and can be further appropriately adjusted to the unit characteristics.

A CPU 34, and a transmitter circuit board 31 and a receiver-side circuit board 23, are connected between the main unit 2 and sheet feeding mechanism 10 through connectors 32, 33, respectively. As a result, the sheet feeding mechanism 10 can be electrically connected to the main unit 2 by simply connecting these connectors 32, 33, and the ease of installing the sheet feeding mechanism 10 to the main unit 2 can be improved. In addition, because connecting the sheet feeding mechanism 10 and adjustment device 44 is simple, the ease of adjusting the sensor unit 20 is also improved.

The sheet feeding mechanism 10 above is constructed as a unit that includes the installation base 12, sheet feeding unit 13, and sensor unit 20 for multifeed detection, and can be installed as a unit to the main unit 2. As a result, the sheet feeding mechanism 10 can be assembled separately from the main unit 2, and the sensor unit 20 can be adjusted. As a result, factory assembly and adjustment can be simplified and repairs can be simplified while assuring the performance of the multifeed detection function, and the invention can be used to good effect in a check processing device 1.

More specifically, because the sensor unit 20 includes the ultrasonic transmitter 21, ultrasonic receiver 22, and circuit unit 24, reliable multifeed detection is possible using an ultrasonic sensor, which has a low signal detection level and requires precise adjustment.

Because the sheets 3 are supplied from the sheet feeding unit 13 to the conveyance path 5 standing on edge, the ultrasonic transmitter 21 and ultrasonic receiver 22 of the sensor unit 20 can be disposed facing each other horizontally. As a result, the effect of paper dust and other particulate that can adversely affect ultrasonic detection can be reduced, and multifeed detection by the sensor unit 20 can be assured.

Furthermore, because checks and other small slips are used as the sheets 3, the height from the installation base 12 can be minimized, and the sheet feeding mechanism 10 can be efficiently disposed to the main unit 2.

The ultrasonic transmitter 21 and ultrasonic receiver 22 in this embodiment are disposed closer to the sheet feeding unit 13 than the magnetic scanner **6*a*, print unit 6*b*, and optical scanner 6*c*. Because a long distance can therefore be provided between the ultrasonic transmitter 21 and ultrasonic receiver 22 and the processing unit 6, time sufficient to stop the first paper feed roller 8*a* and stop processing by the processing unit 6 before the sheets 3 reach the processing unit 6 can be assured. More particularly, by making this distance long, conveyance of the sheets 3 can be stopped before processing by the processing unit 6 even if the sheets 3** are conveyed at high speed.

Note that even if magnetic information and optical information are read by the magnetic scanner 6*a* and optical scanner 6*c* when sheets 3 are multifed, the sheets 3 are not physically changed. Therefore, even if the multifed sheets 3 pass the magnetic scanner 6*a* and optical scanner 6*c*, the magnetic information and optical information captured by the magnetic scanner 6*a* and optical scanner 6*c* can be simply discarded. However, if the sheets 3 are accidentally printed on by the print unit 6*b*, ink will stick to the sheets 3 and the sheets 3 cannot be returned to their original condition.

The magnetic scanner 6*a* is therefore disposed on the upstream side of the print unit 6*b* in this embodiment. As a result, even if the sheets 3 pass the magnetic scanner 6*a*, the first paper feed roller 8*a* and print unit 6*b* can be stopped before the sheets 3 reach the print unit 6*b*. The time required for the sheets 3 to pass the magnetic scanner 6*a* can therefore be added to the time allowed for stopping the printing process before the sheets 3 reach the print unit 6*b*. The printing process can therefore be reliably stopped when sheet 3 multifeeding is detected before irreversible, erroneous processing by the print unit 6*b*.

A preferred embodiment of the invention is described above, but the invention is not so limited and can be varied in many ways without departing from the scope of the invention.

Figure 9:
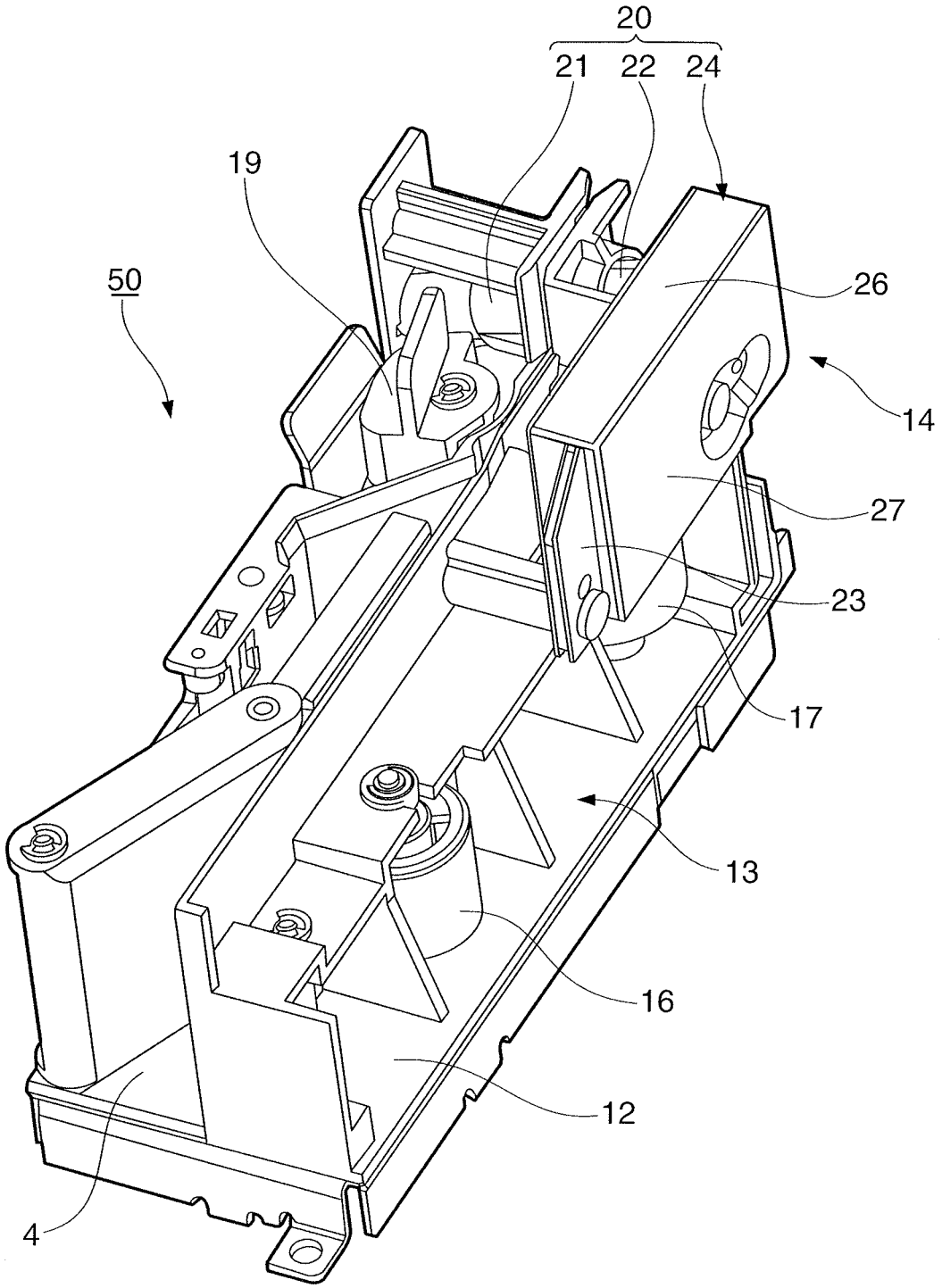
FIG. 9 is an oblique view of the sheet feeding mechanism according to another embodiment of the invention.

For example, the motor 18 is preinstalled to the sheet feeding mechanism 10 in the embodiment described above, but the invention is not so limited and the sheet feeding mechanism 50 could be constructed without the motor attached as shown in FIG. 9. In this case, the sheet feeding mechanism 50 can be installed to the main unit 2 after first later installing the motor. If a problem occurs with the multifeed detection function and the sheet feeding mechanism 50 must be replaced, this configuration makes the repair less expensive because replacing an expensive motor is not necessarily also required.

Stopping the motor 18 and stopping driving the first paper feed roller 8*a* and feed roller 17 are described by example in the embodiment described above, but the invention is not so limited. For example, driving only the feed roller 17 could be stopped to prevent conveying a new sheet 3 to the conveyance path 5, and processing by the magnetic scanner 6*a*, print unit 6*b*, and optical scanner 6*c* could be stopped so that the multifed sheets 3 are not processed.

The paper feed rollers 8*a* to 8*c* on the main unit 2 side, and the pickup roller 16 and the feed roller 17 of the sheet feeding mechanism 10, are driven by the same motor 18 in the foregoing embodiment, but these could be driven by separate motors.

The magnetic scanner 6*a* is disposed on the upstream side of the print unit 6*b* in the embodiment described above, but the optical scanner 6*c*, or the magnetic scanner 6*a* and the optical scanner 6*c*, could be disposed on the upstream side of the print unit 6*b*. The magnetic scanner 6*a* and optical scanner 6*c* can also be omitted depending on the application of the check processing device 1.

The foregoing embodiment has the magnetic scanner 6*a* disposed between the sheet feeding unit 13 and print unit 6*b*, but the invention is not so limited. For example, the magnetic scanner 6*a* and the ultrasonic transmitter 21 could be disposed one above the other at the same position on the conveyance path 5.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An image processing device comprising:

a main unit having a conveyance path for conveying a sheet; a processing unit that applies a specific process to the sheet conveyed through the conveyance path; and a multifeed detection unit comprising:

a sheet-passing unit disposed contiguously to the conveyance path, an ultrasonic transmitter disposed facing the sheet-passing unit, and an ultrasonic receiver disposed opposite the ultrasonic transmitter with the sheet-passing unit therebetween, wherein the multifeed detection unit is removably installed to the main unit, and wherein the multifeed detection unit is configured to detect multifeeding of the sheet.

2. The image processing device described in claim 1, wherein:

the multifeed detection unit also has a paper feed mechanism that supplies the sheet through the sheet-passing unit to the conveyance path.

3. The image processing device described in claim 2, wherein:

the ultrasonic transmitter and ultrasonic receiver are on the downstream side of the paper feed mechanism and the upstream side of the processing unit on the conveyance path.

4. The image processing device described in claim 3, wherein:

the ultrasonic transmitter and ultrasonic receiver are closer to the paper feed mechanism than the processing unit on the conveyance path.

5. The image processing device described in claim 1, wherein:

at least one paper feed roller is located on the downstream side of the ultrasonic transmitter and ultrasonic receiver and the upstream side of the processing unit.

6. The image processing device described in claim 1, wherein:

the processing unit includes a print unit that prints on the sheet, and a reading unit that reads information on the sheet; and the reading unit is on the upstream side of the print unit and the downstream side of the ultrasonic transmitter and ultrasonic receiver on the conveyance path.

7. The image processing device described in claim 2, wherein:

the multifeed detection unit also has a drive unit that drives the paper feed mechanism.

8. The image processing device described in any claim 2, wherein:

the multifeed detection unit also has a hopper that holds the sheet; and the paper feed mechanism feeds the sheet held in the hopper to the conveyance path.

9. The image processing device described in claim 1, wherein:

the multifeed detection unit has a receiver-side circuit unit that applies a specific process to an output signal from the ultrasonic receiver.

10. The image processing device described in claim 9, wherein:

the receiver-side circuit unit is disposed to the multifeed detection unit at a position facing the outside.

11. The image processing device described in claim 9, wherein:

the receiver-side circuit has an amplifier circuit that amplifies the output signal of the ultrasonic receiver and outputs the amplified signal, and a comparator that compares at least a part of the output value of the amplified signal with a specific threshold value.

12. The image processing device described in claim 9, wherein:

the multifeed detection unit also has a transmitter-side circuit unit that outputs a drive signal to the ultrasonic transmitter.

13. The image processing device described in claim 12, wherein:

the main unit also has a control unit that controls the receiver-side circuit unit and the transmitter-side circuit unit; and connectors that respectively connect the control unit to the receiver-side circuit unit and the transmitter-side circuit unit are disposed between the main unit and the multifeed detection unit.

14. A sheet feeding mechanism that is installed to a device having a main unit that applies a specific process to a sheet conveyed through a conveyance path, and supplies the sheet to the conveyance path, the sheet feeding mechanism comprising:

an installation base;

a sheet feeding unit that is disposed to the installation base and supplies the sheet to the conveyance path; and a multifeed detection unit that is disposed to the installation base, detects multifeeding of the sheets to the conveyance path, and has a sensor unit that detects sheet multifeeding, wherein the installation base is removably installable to the main unit, and wherein the multifeed detection unit is configured to detect multifeeding of the sheet.

15. The sheet feeding mechanism described in claim 14, wherein:

the sensor unit includes an ultrasonic transmitter, an ultrasonic receiver disposed opposite the ultrasonic transmitter, and a circuit unit that processes at least the output signal of the ultrasonic receiver.

16. The sheet feeding mechanism described in claim 15, wherein:

the circuit unit is installed to the sheet feeding mechanism exposed to the outside.

17. The sheet feeding mechanism described in claim 14, wherein:

the sheet feeding unit includes a sheet holding unit that holds the sheets in a stack, and a paper feed roller that supplies the sheets in the sheet holding unit to the conveyance path.

18. The sheet feeding mechanism described in claim 17, further comprising:

a drive unit that drives the paper feed roller.

19. The sheet feeding mechanism described in claim 14, wherein:

the sheets are supplied standing on edge from the sheet feeding unit to the conveyance path.

20. The sheet feeding mechanism described in claim 14, wherein:

the sheets are checks.

* * * * *